US009072940B1

(12) United States Patent
Gutierrez

(10) Patent No.: US 9,072,940 B1
(45) Date of Patent: Jul. 7, 2015

(54) DOORWAY EXERCISE SYSTEM

(71) Applicant: Ernel Gutierrez, Las Vegas, NV (US)

(72) Inventor: Ernel Gutierrez, Las Vegas, NV (US)

( * ) Notice: Subject to any disclaimer, the term of this patent is extended or adjusted under 35 U.S.C. 154(b) by 212 days.

(21) Appl. No.: 13/874,753

(22) Filed: May 1, 2013

(51) Int. Cl.
*A63B 1/00* (2006.01)
*A63B 21/04* (2006.01)
*A63B 21/16* (2006.01)

(52) U.S. Cl.
CPC ..... *A63B 21/1627* (2013.01)

(58) Field of Classification Search
CPC ..... A63B 21/1627; A63B 21/16; A63B 21/1618; A63B 21/1636; A63B 21/1654; A63B 21/1663
USPC ..... 482/129, 131, 38–40, 41–43, 95–96, 482/143, 148; 292/258, 259 R, 278, 292/288–291, 297, 298, 340, 341
See application file for complete search history.

(56) References Cited

U.S. PATENT DOCUMENTS 3,752,473 A 8/1973 LaLanne
D297,957 S 10/1988 Gordon
5,362,295 A 11/1994 Nurge
5,776,033 A 7/1998 Brown
5,941,802 A 8/1999 Kiser
6,514,182 B1 2/2003 Chhloeum
7,837,602 B1 11/2010 Drybread
2003/0158024 A1* 8/2003 Saure ..... 482/126
2010/0204014 A1* 8/2010 Hoffman ..... 482/8
2011/0237410 A1* 9/2011 Perez ..... 482/129
2014/0106948 A1* 4/2014 Agostini ..... 482/129
2014/0221176 A1* 8/2014 Zylstra ..... 482/124
2014/0235413 A1* 8/2014 Pfitzer ..... 482/129

* cited by examiner

*Primary Examiner* — Loan H Thanh
*Assistant Examiner* — Megan Anderson

(57) ABSTRACT

An exercise system using a door frame has a cylindrical bar perpendicularly located between a first jamb and a second jamb. A first vertical post is located on the first jamb below the cylindrical bar and has incrementally spaced first rings. A second vertical post is located on the second jamb below the cylindrical bar and has incrementally spaced second rings. A padded resistance member has first end elastic bands extending from a resistance member first end and second end elastic bands extending from a resistance member second end. At least one of the first end elastic bands has a first hook member located on one of the first rings and at least one of the second end elastic bands has a second hook member located on one of the second rings.

5 Claims, 4 Drawing Sheets

DOORWAY EXERCISE SYSTEM

BACKGROUND OF THE INVENTION

Pull-ups and chin-ups are a popular form of exercise performed with a pull-up (or chin-up) bar. Other exercises can be performed with this device as well. Typically for a novice, however, a pull-up or a chin-up can be difficult to do, thus requiring assistance. Additionally, for an experienced person, a pull-up or a chin-up can become relatively easy to do, thus requiring resistance. The present invention features a versatile doorway exercise system using a pull-up bar while adding assistance or resistance as desired.

SUMMARY

The present invention features an exercise system using a standard sized door frame. In some embodiments, the system comprises a linear cylindrical bar with a bar first end perpendicularly located on a first jamb close to a first jamb anterior end and a bar second end perpendicularly located on a second jamb close to a second jamb anterior end. In some embodiments, the system comprises a linear first vertical post located on the first jamb below the cylindrical bar having a plurality of incrementally spaced first rings. In some embodiments, the system comprises a linear second vertical post located on the second jamb below the cylindrical bar having a plurality of incrementally spaced second rings. In some embodiments, the system comprises a padded resistance member having a plurality of first end elastic bands extending from a resistance member first end and a plurality of second end elastic bands extending from a resistance member second end. In some embodiments, each of the plurality of first end elastic bands comprises a first hook member, at least one of which is removably located on one of the plurality of first rings. In some embodiments, each of the plurality of second end elastic bands comprises a second hook member, at least one of which is removably located on one of the plurality of second rings.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
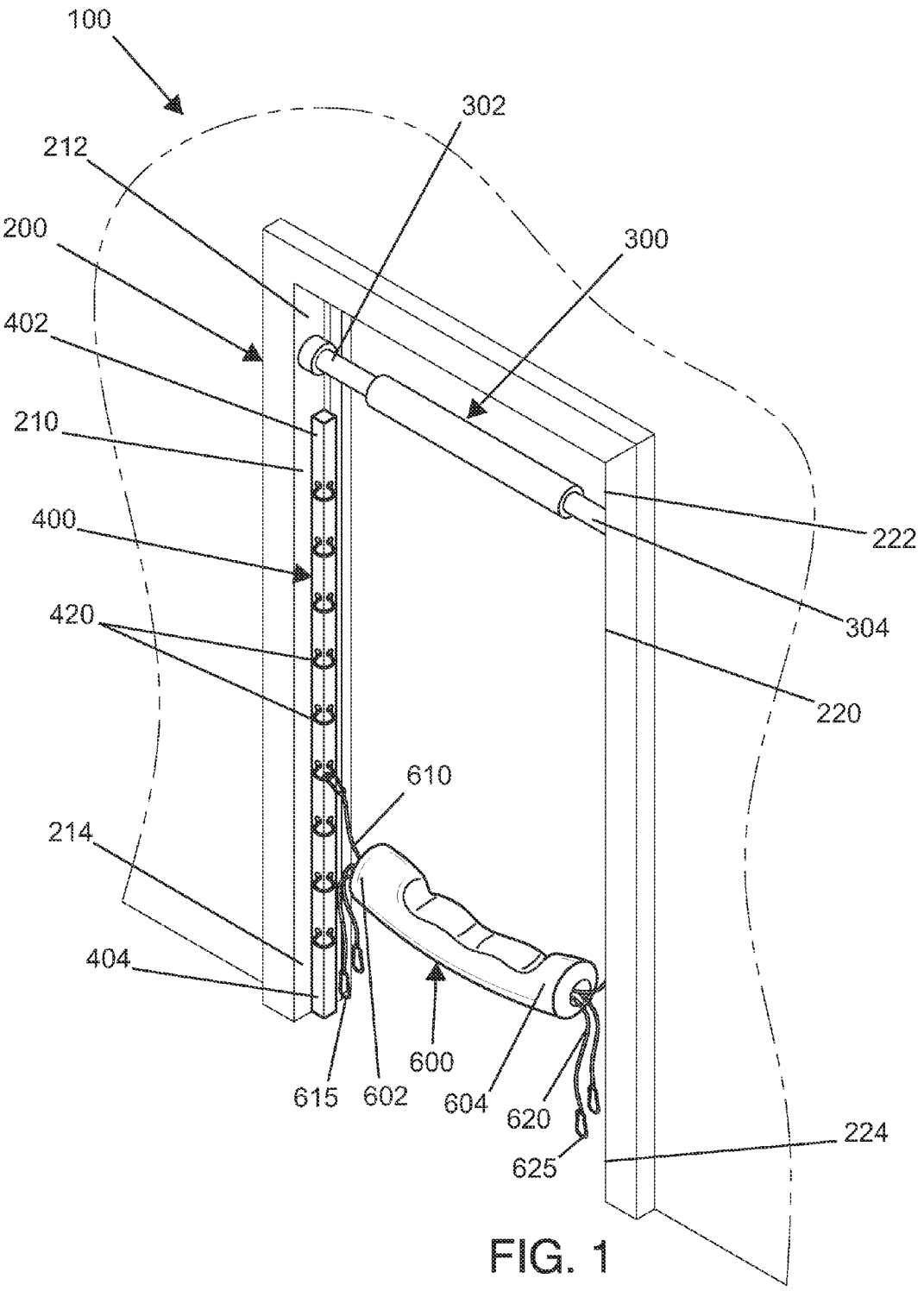
FIG. 1 is a perspective view of the present invention.
Figure 2:
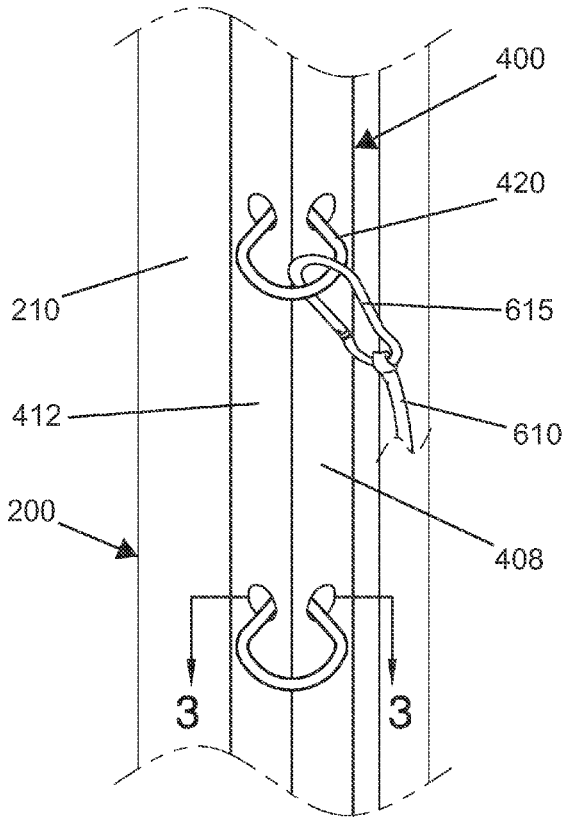
FIG. 2 is a close-up view of the first vertical post of the present invention.
Figure 3:
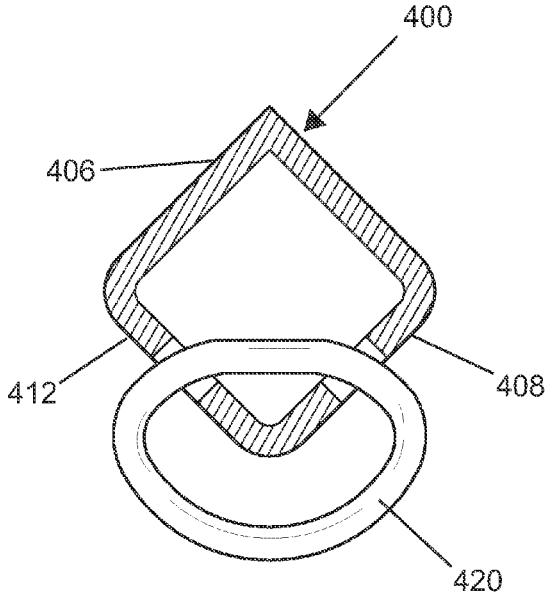
FIG. 3 is a cross-sectional view in a transverse plane of the first post of the present invention featuring the first ring.
Figure 4A:
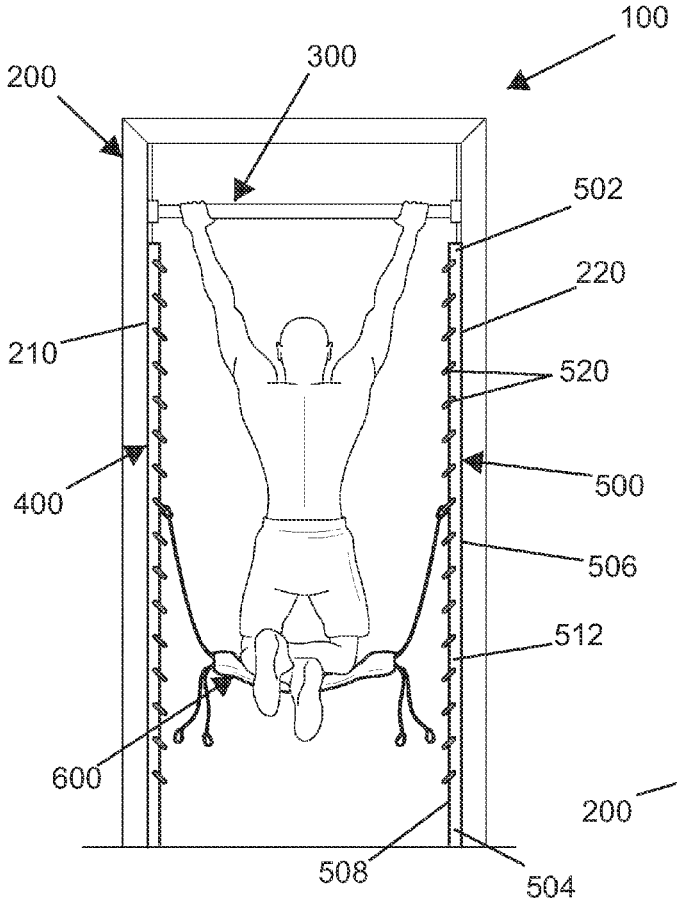
FIG. 4A is a view of the present invention in use providing assistance for a pull-up.
Figure 4B:
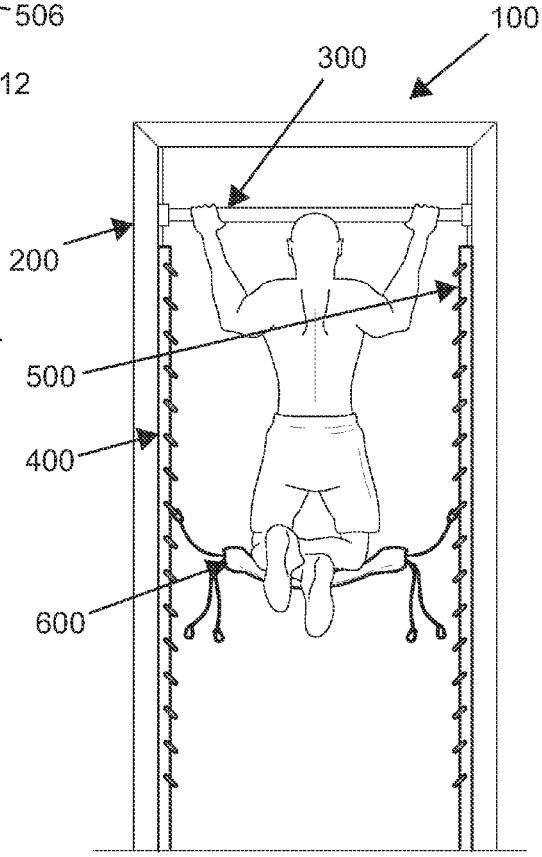
FIG. 4B is a view of the present invention in use providing assistance for a pull-up.
Figure 4C:
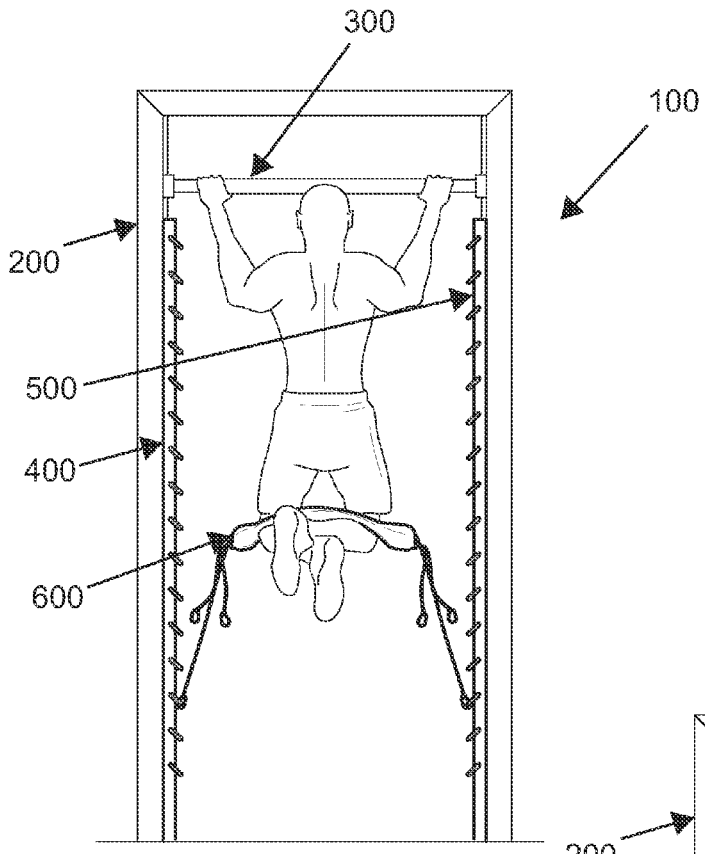
FIG. 4C is a view of the present invention in use providing resistance for a pull-up.
Figure 4D:
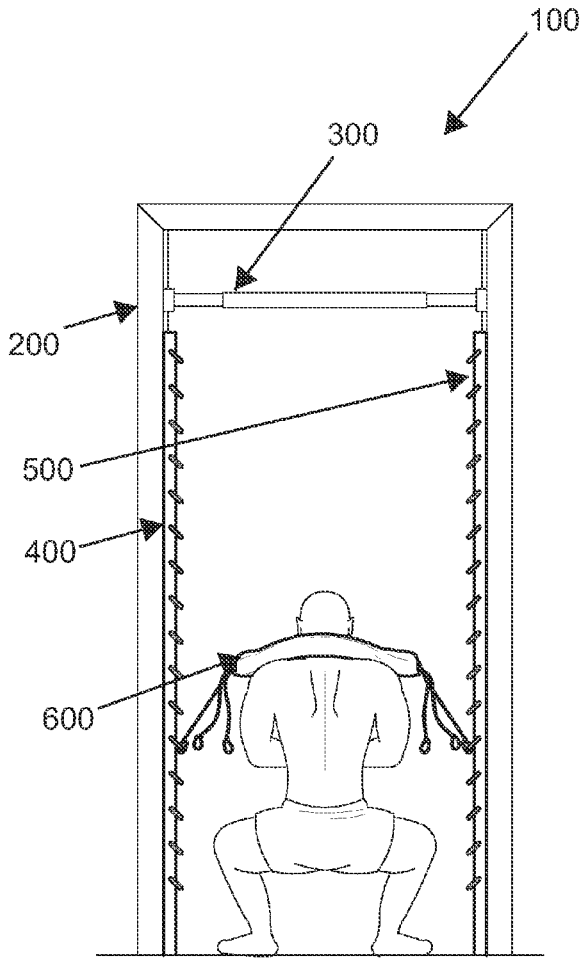
FIG. 4D is a view of the present invention in use providing resistance for a squat.

Following is a list of elements corresponding to a particular element referred to herein:

100 Doorway exercise system
200 Door frame
210 First jamb
212 First jamb anterior end
214 First jamb posterior end
220 Second jamb
222 Second jamb anterior end
224 Second jamb posterior end
300 Cylindrical bar
302 Bar first end
304 Bar second end
400 First vertical post
402 First post anterior end
404 First post posterior end
406 First post inside surface
408 First post outside surface
412 First post first surface
420 First ring
500 Second vertical post
502 Second post anterior end
504 Second post posterior end
506 Second post inside surface
508 Second post outside surface
512 Second post first surface
520 Second ring
600 Resistance member
602 Resistance member first end
604 Resistance member second end
610 First end elastic band
615 First hook member
620 Second end elastic band
625 Second hook member Referring now to FIGS. 1-4D, the present invention features a versatile doorway exercise system (100) using a pull-up bar while adding assistance or resistance. In some embodiments, the system (100) comprises a door frame (200) having a vertical first jamb (210) and a vertical second jamb (220) located opposed to and parallel with the first jamb (210). In some embodiments, the first jamb (210) comprises a first jamb anterior end (212) and a first jamb posterior end (214). In some embodiments, the second jamb (220) comprises a second jamb anterior end (222) and a second jamb posterior end (224).

In some embodiments, the system (100) comprises a linear cylindrical bar (300) having a bar first end (302) and a bar second end (304). In some embodiments, the bar first end (302) is perpendicularly located on the first jamb (210) close to the first jamb anterior end (212). In some embodiments, the bar second end (304) is perpendicularly located on the second jamb (220) close to the second jamb anterior end (222).

In some embodiments, the system comprises a linear first vertical post (400) having a first post anterior end (402), a first post posterior end (404), a first post inside surface (406), and a first post outside surface (408). In some embodiments, the first vertical post (400) comprises a rectangular cross-section in a transverse plane. In some embodiments, the first vertical post (400) is located on the first jamb (210). In some embodiments, the first post inside surface (406) is parallel to and interfaces with the first jamb (210). In some embodiments, the first vertical post (400) comprises a plurality of first rings (420) located thereon. In some embodiments, the plurality of first rings (420) is incrementally spaced between the first post anterior end (402) and the first post posterior end (404).

In some embodiments, the system (100) comprises a linear second vertical post (500) having a second post anterior end (502), a second post posterior end (504), a second post inside surface (506), and a second post outside surface (508). In some embodiments, the second vertical post (500) comprises a rectangular cross-section in a transverse plane. In some embodiments, the second vertical post (500) is located on the second jamb (220). In some embodiments, the second post inside surface (506) is parallel to and interfaces with the second jamb (220). In some embodiments, the second vertical post (500) comprises a plurality of second rings (520) located thereon. In some embodiments, the plurality of second rings (520) is incrementally spaced between the second post anterior end (502) and the second post posterior end (504).

In some embodiments, the first rings (420) are located about 6 inches apart from each other. In some embodiments, the first rings (420) are located about 12 inches apart from each other. In some embodiments, the second rings (520) are located about 6 inches apart from each other. In some embodiments, the second rings (520) are located about 12 inches apart from each other.

In some embodiments, the system (100) comprises a padded resistance member (600) having a plurality of first end elastic bands (610) extending from a resistance member first end (602) and a plurality of second end elastic bands (620) extending from a resistance member second end (604). In some embodiments, each one of the plurality of first end elastic bands (610) comprises a first hook member (615). In some embodiments, each one of the plurality of second end elastic bands (620) comprises a second hook member (625). In some embodiments, at least one first hook member (615) is removably located on one of the plurality of first rings (420). In some embodiments, at least one second hook member (625) is removably located on one of the plurality of second rings (520).

In some embodiments, the location of the first ring (420) is chosen for attachment based on the desired position of the resistance member (600) for the user relative to the distance between the resistance member (600) and the cylindrical bar (300) or the floor. In some embodiments, the location of the second ring (520) is chosen based on the desired position of the resistance member (600) for the user relative to the distance between the resistance member (600) and the cylindrical bar (300) or the floor.

In some embodiments, additional first hook members (615) are attached to or disattached from the selected first ring (420) to increase or decrease resistance or assistance for the user. In some embodiments, additional second hook members (625) are attached to or disattached from the selected second ring (520) to increase or decrease resistance or assistance for the user.

Pull-Up with Resistance.

In some embodiments, the user bends the knees while placing the resistance member (600) on a top surface of each calf behind the knees while placing the hands on the cylindrical bar (300) for use for a pull-up exercise with resistance.

Pull Up with Assistance.

In some embodiments, the user bends the knees while placing the resistance member (600) on a front surface of the knees while placing the hands on the cylindrical bar (300) for use for a pull-up exercise with assistance.

Squat with Resistance.

In some embodiments, the user stands with feet on the ground and bends the knees while placing the resistance member (600) on a top surface of the shoulders for use for a squat exercise with resistance.

In some embodiments, the first ring (420) and the second ring (520) are oval.

In some embodiments, the first ring (420) is located on a corner of an intersection of the first post outside surface (408) and a first post first surface (412). In some embodiments, the first ring (420) is not located on a corner of an intersection of the first post outside surface (408) and a first post second surface. In some embodiments, the second ring (520) is located on a corner of an intersection of the second post outside surface (508) and a second post first surface (512). In some embodiments, the second ring (520) is not located on a corner of an intersection of the second post outside surface (508) and a second post second surface.

In some embodiments, the first hook member (615) is a spring biased ring hook. In some embodiments, the second hook member (625) is a spring biased ring hook.

In some embodiments, a method of exercise comprises obtaining a doorway exercise system (100). In some embodiments, the system (100) comprises a versatile doorway exercise system (100) using a pull-up bar while adding assistance or resistance. In some embodiments, the system (100) comprises a door frame (200) having a vertical first jamb (210) and a vertical second jamb (220) located opposed to and parallel with the first jamb (210). In some embodiments, the first jamb (210) comprises a first jamb anterior end (212) and a first jamb posterior end (214). In some embodiments, the second jamb (220) comprises a second jamb anterior end (222) and a second jamb posterior end (224).

In some embodiments, the system (100) comprises a linear cylindrical bar (300) having a bar first end (302) and a bar second end (304). In some embodiments, the bar first end (302) is perpendicularly located on the first jamb (210) close to the first jamb anterior end (212). In some embodiments, the bar second end (304) is perpendicularly located on the second jamb (220) close to the second jamb anterior end (222).

In some embodiments, the system comprises a linear first vertical post (400) having a first post anterior end (402), a first post posterior end (404), a first post inside surface (406), and a first post outside surface (408). In some embodiments, the first vertical post (400) comprises a rectangular cross-section in a transverse plane. In some embodiments, the first vertical post (400) is located on the first jamb (210). In some embodiments, the first post inside surface (406) is parallel to and interfaces with the first jamb (210). In some embodiments, the first vertical post (400) comprises a plurality of first rings (420) located thereon. In some embodiments, the plurality of first rings (420) is incrementally spaced between the first post anterior end (402) and the first post posterior end (404).

In some embodiments, the system (100) comprises a linear second vertical post (500) having a second post anterior end (502), a second post posterior end (504), a second post inside surface (506), and a second post outside surface (508). In some embodiments, the second vertical post (500) comprises a rectangular cross-section in a transverse plane. In some embodiments, the second vertical post (500) is located on the second jamb (220). In some embodiments, the second post inside surface (506) is parallel to and interfaces with the second jamb (220). In some embodiments, the second vertical post (500) comprises a plurality of second rings (520) located thereon. In some embodiments, the plurality of second rings (520) is incrementally spaced between the second post anterior end (502) and the second post posterior end (504).

In some embodiments, the system (100) comprises a padded resistance member (600) having a plurality of first end elastic bands (610) extending from a resistance member first end (602) and a plurality of second end elastic bands (620) extending from a resistance member second end (604). In some embodiments, each one of the plurality of first end elastic bands (610) comprises a first hook member (615). In some embodiments, each one of the plurality of second end elastic bands (620) comprises a second hook member (625). In some embodiments, at least one first hook member (615) is removably located on one of the plurality of first rings (420). In some embodiments, at least one second hook member (625) is removably located on one of the plurality of second rings (520).

In some embodiments, the location of the first ring (420) is chosen for attachment based on the desired position of the resistance member (600) for the user relative to the distance between the resistance member (600) and the cylindrical bar (300) or the floor. In some embodiments, the location of the second ring (520) is chosen based on the desired position of the resistance member (600) for the user relative to the distance between the resistance member (600) and the cylindrical bar (300) or the floor.

In some embodiments, additional first hook members (615) are attached to or disattached from the selected first ring (420) to increase or decrease resistance or assistance for the user. In some embodiments, additional second hook members (625) are attached to or disattached from the selected second ring (520) to increase or decrease resistance or assistance for the user.

In some embodiments, the method comprises attaching the first hook member (615) to the first ring (420) and attaching the second hook member (625) to the second ring (520). In some embodiments, the first ring (420) is chosen based on the desired position of the resistance member (600) for the user relative to the distance between the resistance member (600) and the cylindrical bar (300). In some embodiments, the second ring (520) is chosen based on the desired position of the resistance member (600) for the user relative to the distance between the resistance member (600) and the cylindrical bar (300). In some embodiments, the method comprises attaching additional first hook members (615) to the first ring (420) and attaching additional second hook members (625) to the second ring (520) to increase resistance for the user.

In some embodiments, the method comprises bending each knee of the user while placing the resistance member (600) on a top surface of each calf as to hook the resistance member (600) behind the knee of the user while placing each hand of the user on the cylindrical bar (300). In some embodiments, the method comprises pulling ones self upward toward the cylindrical bar (300) to test the resistance from the resistance member (600). In some embodiments, the method comprises adjusting the location of the first ring (420) and the second ring (520) if necessary. In some embodiments, the method comprises adjusting the number of first hook members (615) and second hook members (625) used to provide resistance to the user. In some embodiments, the method comprises repeatedly pulling one's self upward toward the cylindrical bar (300) and lowering one's self downward away from the cylindrical bar (300) a number of times.

As used herein, the term "about" refers to plus or minus 10% of the referenced number. For example, an embodiment wherein the resistance member is about 10 inches in length includes a resistance member that is between 9 and 11 inches in length.

The disclosures of the following U.S. Patents are incorporated in their entirety by reference herein: U.S. Pat. No. D 297,957; U.S. Pat. No. 7,837,602; U.S. Pat. No. 6,514,182; U.S. Pat. No. 5,941,802; U.S. Pat. No. 5,776,033; U.S. Pat. No. 5,362,295; and U.S. Pat. No. 3,752,473.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A versatile doorway exercise system using a pull-up bar while adding assistance or resistance, wherein said system comprises:

a. a door frame having a vertical first jamb and a vertical second jamb disposed opposed to and parallel with the first jamb, wherein the first jamb comprises a first jamb anterior end and a first jamb posterior end, wherein the second jamb comprises a second jamb anterior end and a second jamb posterior end;

b. a linear cylindrical bar having a bar first end and a bar second end, wherein the bar first end is perpendicularly disposed on the first jamb proximal to the first jamb anterior end, wherein the bar second end is perpendicularly disposed on the second jamb proximal to the second jamb anterior end;

c. a linear first vertical post having a first post anterior end, a first post posterior end, a first post inside surface, and a first outside surface, wherein the first vertical post comprises a rectangular cross-section in a transverse plane, wherein the first vertical post is disposed on the first jamb, wherein the first post inside surface is parallel to and interfaces with the first jamb, wherein the first vertical post comprises a plurality of rings disposed thereon, wherein the plurality of first rings are incrementally spaced between the first post anterior end and the first post posterior end;

d. a linear second vertical post having a second post anterior end, a second post posterior end, a second post inside surface, and a second post outside surface, wherein the second vertical post comprises a rectangular cross-section in a transverse plane, wherein the second vertical post is disposed on the second jamb, wherein the second post inside surface is parallel to and interfaces with the second jamb, wherein the second vertical post comprises a plurality of second rings disposed thereon, wherein the plurality of second rings are incrementally spaced between the second post anterior end and the second post posterior end; and e. a padded resistance member having a plurality of first end elastic bands extending from a resistance member first end and a plurality of second end elastic bands extending from a resistance member second end, wherein each one of the plurality of first end elastic bands comprises a first hook member, wherein each one of the plurality of second end elastic bands comprises a second hook member, wherein at least one first hook member is removably disposed on one of the plurality of first rings, and wherein at least one second hook member is removably disposed on one of the plurality of second rings;

wherein a location of the first ring is chose for attachment based on a desired position of the resistance member for a user relative to a distance between the resistance member and the cylindrical bar or a floor, wherein a location of the second ring is chosen based on the desired position of the resistance member for the user relative to the distance between the resistance member and the cylindrical bar or the floor;

wherein additional first hook members are attached to or disattached from the selected first ring to increase or decrease resistance or assistance for the user, wherein additional second hook members are attached or disattached from the selected second ring to increase or decrease resistance or assistance for the user;

wherein the user bends at a pair of knees while placing the resistance member on a top surface of each calf behind the knees while placing a pair of hands on the cylindrical bar for use for a pull-up exercise with resistance;

wherein the user bends the knees while placing the resistance member on the front surface of the knees while placing the hands on the cylindrical bar for use for a pull-up exercise with assistance;

wherein the user stands with a pair of feet on the floor and bends the knees while placing the resistance member on a top surface of a pair of shoulders for use for a squat exercise with resistance.

2. The system of claim 1, wherein the first ring and the second ring are oval.

3. The system of claim 1, wherein the first ring is disposed on a corner of an intersection of the first post outside surface and a first post first surface, wherein the first ring is not disposed on a corner of an intersection of the first post outside surface and a first post second surface, wherein the second ring is disposed on a corner of an intersection of the second post outside surface and a second post first surface, wherein the second ring is not disposed on a corner of an intersection of the second post outside surface and a second post second surface.

4. The system of claim 1, wherein the first hook member is a spring biased ring hook, wherein the second hook member is a spring biased ring hook.

5. A method of exercise, wherein said method comprises:

a. obtaining a doorway exercise system, wherein said system comprises:

i. a door frame having a vertical first jamb and a vertical second jamb disposed opposed to and parallel with the first jamb, wherein the first jamb comprises a first jamb anterior end and a first jamb posterior end, wherein the second jamb comprises a second jamb anterior end and a second jamb posterior end;

ii. a linear cylindrical bar having a bar first end and a bar second end, wherein the bar first end is perpendicularly disposed on the first jamb proximal to the first jamb anterior end, wherein the bar second end is perpendicularly disposed on the second jamb proximal to the second jamb anterior end;

iii. a linear first vertical post having a first post anterior end, a first post posterior end, a first post inside surface, and a first outside surface, wherein the first vertical post comprises a rectangular cross-section in a transverse plane, wherein the first vertical post is disposed on the first jamb, wherein the first post inside surface is parallel to and interfaces with the first jamb, wherein the first vertical post comprises a plurality of rings disposed thereon, wherein the plurality of first rings are incrementally spaced between the first post anterior end and the first post posterior end;

iv. a linear second vertical post having a second post anterior end, a second post posterior end, a second post inside surface, and a second post outside surface, wherein the second vertical post comprises a rectangular cross-section in a transverse plane, wherein the second vertical post is disposed on the second jamb, wherein the second post inside surface is parallel to and interfaces with the second jamb, wherein the second vertical post comprises a plurality of second rings disposed thereon, wherein the plurality of second rings are incrementally spaced between the second post anterior end and the second post posterior end; and v. a padded resistance member having a plurality of first end elastic bands extending from a resistance member first end and a plurality of second end elastic bands extending from a resistance member second end, wherein each one of the plurality of first end elastic bands comprises a first hook member, wherein each one of the plurality of second end elastic bands comprises a second hook member, wherein at least one first hook member is removably disposed on one of the plurality of first rings, and wherein at least one second hook member is removably disposed on one of the plurality of second rings;

b. attaching a first hook member to the first ring and attaching the second hook member to the second ring, wherein the first ring is chosen based on a desired position of the resistance member for a user relative to a distance between the resistance member and the cylindrical bar, wherein the second ring is chosen based on the desired position of the resistance member for the user relative to the distance between the resistance member and the cylindrical bar, wherein attaching additional first hook members to the first ring and attaching additional second hook members to the second ring increases resistance for the user;

c. bending each knee of the user while placing the resistance member on a top surface of each calf as to hook the resistance member behind the knee of the user while placing each hand of the user on the cylindrical bar;

d. pulling one's self upward towards the cylindrical bar to test resistance from the resistance member;

e. adjusting a location of the first ring and the second ring if necessary;

f. adjusting a number of first hook members and second hook members used to provide resistance to the user; and g. repeatedly pulling one's self upwards towards the cylindrical bar and lowering one's self downward away from the cylindrical bar a number of times to achieve exercise.

* * * * *